US007516801B2

(12) United States Patent
Meixner et al.

(10) Patent No.: US 7,516,801 B2
(45) Date of Patent: Apr. 14, 2009

(54) IMPACT MECHANISM FOR A REPEATEDLY STRIKING HAND-HELD MACHINE TOOL

(75) Inventors: Gerhard Meixner, Filderstadt (DE); Juergen Lennartz, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/553,300

(22) PCT Filed: Oct. 27, 2004

(86) PCT No.: PCT/DE2004/002392

§ 371 (c)(1),
(2), (4) Date: Oct. 14, 2005

(87) PCT Pub. No.: WO2005/058551

PCT Pub. Date: Jun. 30, 2005

(65) Prior Publication Data

US 2006/0196683 A1 Sep. 7, 2006

(30) Foreign Application Priority Data

Dec. 18, 2003 (DE) ..... 103 59 572

(51) Int. Cl.
*B25D 11/04* (2006.01)

(52) U.S. Cl. ..... 173/112; 173/104; 173/91; 173/114; 173/200

(58) Field of Classification Search ..... 173/104, 173/91, 112, 114, 200, 201, 144, 90, 128, 173/132.114
See application file for complete search history.

(56) References Cited

U.S. PATENT DOCUMENTS

| | | | | |
|---|---|---|---|---|
| 4,476,941 | A * | 10/1984 | Buck et al. | 173/117 |
| 6,116,352 | A * | 9/2000 | Frauhammer et al. | 173/212 |
| 6,675,908 | B1 * | 1/2004 | Frauhammer et al. | 173/48 |
| 6,810,969 | B2 * | 11/2004 | Meixner | 173/201 |
| 7,023,683 | B1 * | 4/2006 | Guo et al. | 361/166 |
| 7,028,786 | B2 * | 4/2006 | Kuhnle et al. | 173/131 |
| 2002/0050365 | A1 * | 5/2002 | Bongers-Ambrosius et al. | 173/128 |
| 2002/0179310 | A1 * | 12/2002 | Kuhnle et al. | 173/114 |

FOREIGN PATENT DOCUMENTS

| | | |
|---|---|---|
| DE | 479 472 | 7/1929 |
| DE | 35 26 162 A1 | 1/1987 |
| DE | 198 10 088 C1 | 8/1999 |
| GB | 2285007 A * | 6/1995 |

* cited by examiner

*Primary Examiner*—Brian D Nash
(74) *Attorney, Agent, or Firm*—Michael J. Striker

(57) ABSTRACT

A percussion mechanism for a repetitively hammering hand power tool, whose striking frequency and striking intensity are controllable independently of one another, has a striker (2), movable axially forward and backward in a guide barrel (1), and a device (5) exerting pressure on the striker (2), as a result of which the striker can be set into a forward motion in the direction of a tool bit (4) that is insertable into the hand power tool. A blocking element (10) is also provided, with which the striker (2) is blockable in its forward motion, and the striking frequency of the striker (2) is adjustable by controlling the blocking time of the blocking element (10).

14 Claims, 2 Drawing Sheets

IMPACT MECHANISM FOR A REPEATEDLY STRIKING HAND-HELD MACHINE TOOL

CROSS-REFERENCE

The invention described and claimed hereinbelow is also described in PCT/DE 2004/002392, filed Oct. 27, 2004 and DE 103 59 572.4, filed Dec. 18, 2003. This German Patent Application, whose subject matter is incorporated here by reference, provides the basis for a claim of priority of invention under 35 U.S.C. 119(a)-(d).

BACKGROUND OF THE INVENTION

The present invention relates to a percussion mechanism for a repetitively hammering hand power tool—preferably a drill hammer and/or percussion hammer—that has a striker which can move axially forward and backward in a guide barrel, and having a device that exerts pressure on the striker, by which the striker can be set into a forward motion in the direction of a tool bit that can be inserted into the hand power tool.

One such compression percussion mechanism that executes repetitive striking motions for an electropneumatic drill hammer and/or percussion hammer, as is taught by German Patent DE 198 10 088 C1, comprises an eccentric drive, a piston, and a striker. With these three elements, a rotary motion is converted into a reciprocating motion. The axial forward and backward motion of the striker in a guide barrel happens in the following way:

The piston moved in the forward direction by the eccentric drive compresses the air cushion between the piston and the striker, causing the striker to shoot freely onto the tool bit inserted into the power tool. The striker transfers its percussion energy to the tool bit and there receives a pulse in the reverse direction. Simultaneously, the piston is likewise moved backward by the eccentric drive, creating a certain underpressure in the air cushion between the piston and the striker. As soon as the piston has reached its turning point and the striker shoots still farther against the piston, the air cushion between the two is compressed, resulting in compression, with the consequence that upon the next forward motion of the piston, the striker shoots forward against the tool bit at an even higher speed.

A compression percussion mechanism of this kind is technically relatively complex, since besides the striker that moves in the axial direction it requires an eccentric drive with a piston that is likewise displaceable in the axial direction. A mutually independent adjustment of the striking frequency and the striking intensity is not possible in a compression percussion mechanism of this kind.

It is therefore the object of the invention to disclose a percussion mechanism of the type defined at the outset which can be implemented with the simplest possible technical means.

SUMMARY OF THE INVENTION

The stated object is attained in that there is a device that exerts pressure on the striker, as a result of which the striker can be set into a forward motion in the direction of a tool bit that can be inserted into the hand power tool, and that a blocking element is provided, with which the striker can be blocked in its forward motion, and the striking frequency of the striker can be adjusted by controlling the blocking time of the blocking element.

The percussion mechanism according to the invention requires few moving mechanical parts and is therefore less subject to wear. Moreover, this percussion mechanism, which unlike conventional compression percussion mechanisms has no eccentric drive and no piston, makes a compact design possible. Furthermore, the striking frequency of the percussion mechanism and the striking intensity can be controlled independently of one another.

Advantageously, the device exerting pressure on the striker comprises a pressure reservoir that is can be filled with a gas and that is located on the side of the striker diametrically opposite the tool bit. The gas—preferably air—can be delivered to the pressure reservoir via an inlet valve, and the quantity of gas delivered, and thus the pressure exerted on the striker, are controllable. For delivering gas to the pressure reservoir, a pump device may be provided, which is located for instance in the hand power tool.

It is expedient that the pump device is located in the hand power tool.

Advantageously, the blocking time of the blocking element can be controlled as a function of a fixedly predetermined or user-controllably selectable striking frequency and/or as a function of the pressure level in the pressure reservoir.

BRIEF DESCRIPTION OF THE DRAWINGS

The invention is described in further detail below in terms of an exemplary embodiment shown in the drawing.

Shown are.

DESCRIPTION OF AN EXEMPLARY EMBODIMENT

Figure 1:
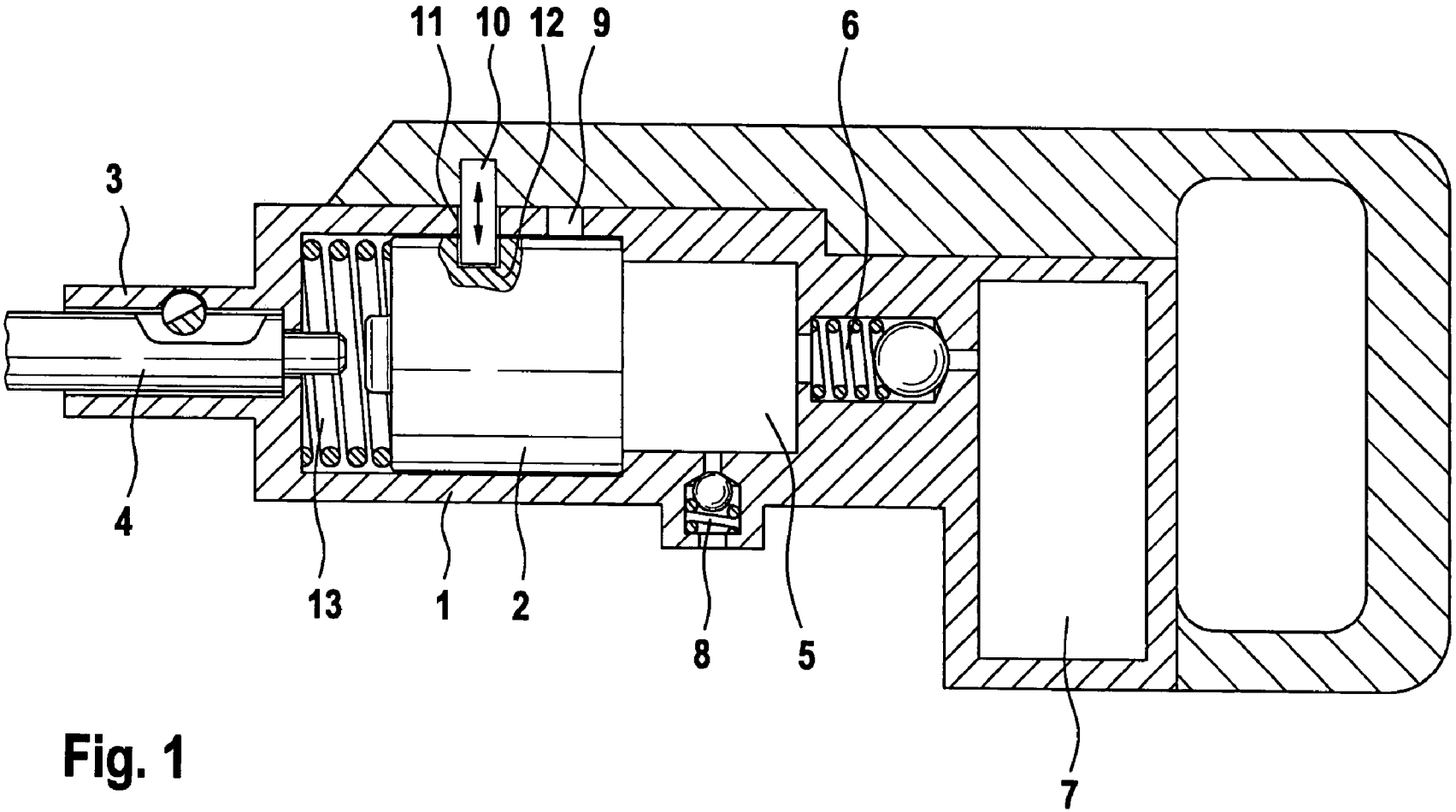
FIG. 1, a longitudinal section through a drill hammer and/or percussion hammer with a percussion mechanism.

In FIG. 1, a drill hammer and/or percussion hammer is shown in longitudinal section, as an example of a repetitively hammering hand power tool; FIG. 1 is essentially limited to those parts that belong to the percussion mechanism of the drill hammer and/or percussion hammer.

The drill hammer and/or percussion hammer has a guide barrel 1, in which a striker 2 is supported, movably axially forward and backward. The guide barrel 1 is adjoined by a tool bit holder 3, in which a tool bit 4, such as a drill or chisel, is inserted, likewise movable within certain limits in the axial direction. In the guide barrel 1, on the backside of the striker 2, which is the side of the striker 2 diametrically opposite the tool bit 4, there is a pressure reservoir 5 filled with a gas —preferably air. This pressure reservoir 5 is filled with gas via an inlet valve 6 by a pump device 7.

In the exemplary embodiment shown, the pump device 7 is located in the hand power tool itself. However, the pump device 7 may also be located outside the hand power tool and may communicate with the inlet valve 6 via a pressure line. The quantity of the gas delivered to the pressure reservoir 5 from the pump device 7 may be controlled via the inlet valve 6, which is for instance an electrically controllable valve. The pressure exerted on the striker 2 and thus the striking intensity exerted by the striker 2 on the tool bit 4 depends on the quantity of gas delivered to the pressure reservoir 5. In other words, the striking intensity of the drill hammer and/or percussion hammer can be controlled via the quantity of gas delivered to the pressure reservoir 5. In the pressure reservoir 5, it is expedient to provide an outlet valve 8 which limits the gas pressure in the pressure reservoir 5 to a predeterminable maximum value.

In the view shown in FIG. 1, the striker 2 is located in an outset position, in which it closes a gas outlet opening 9 located in the guide barrel 1. In this outset position, the striker 2 is restrained by a blocking element 10. The blocking element 10, in a very simple embodiment, is for instance a bolt, which can penetrate through an opening 11 in the side wall of the guide barrel 1 into an indentation 12 in the striker 2. If the blocking element 10 is now pulled out of the indentation 12 in the striker 2, the striker 2, because of the gas pressure in the pressure reservoir 5, shoots in the forward direction toward the tool bit 4 and simultaneously uncovers the gas outlet opening 9 in the guide barrel 1. Thus while the striker 2 is shooting at the tool bit 4 and imparting its percussion impetus to the tool bit 4, the gas pressure is discharged through the gas outlet opening 9 on the backside of the striker 2 facing toward the pressure reservoir 6.

The reverse percussion impetus at the tool bit 4 causes the striker 2 to move in the reverse direction toward the pressure reservoir 5 and to re-close the gas outlet opening 9. The rearward motion of the striker 2 can also be reinforced by a compression spring 13, located on the front side oriented toward the tool bit 4, or by a similarly acting mechanical (for instance pneumatic) or electrically acting device. Once the striker 2, after its rearward motion, has regained its outset position in this way, it is blocked by the blocking element 10, which again penetrates into the indentation 12 in the striker 2. If the blocking element 10 is pulled out of the indentation 12 of the striker 2 again, then the striker 2 executes a new forward motion and in the process exerts a further impact on the tool bit 4. It can be seen that the striking frequency of the striker 2 is controllable solely by the length of the blocking time of the blocking element 10.

Figure 2:
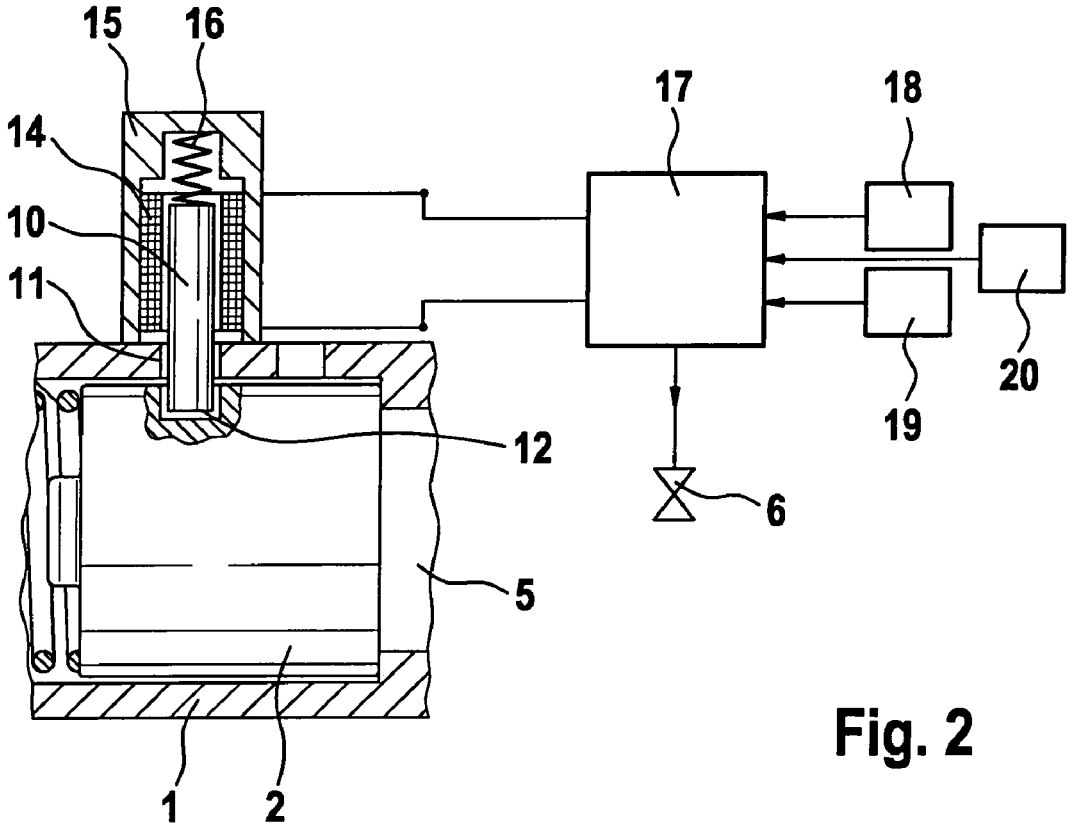
FIG. 2, a detail of the percussion mechanism with control for the striker.

In conjunction with FIG. 2, one possible version of control of the blocking element 10 will now be described in further detail. This view shows a detail of the striker 2 with the blocking element 10 and with the device for controlling for a blocking element 10.

The control of the blocking element into a locking or unlocking position can be done for instance on the principle of an electromagnet. The blocking element 10 then forms a core of ferromagnetic material of a coil 14 to which current can be supplied. The coil 14 is located in a dome 15 placed on the guide barrel 1 over its opening 11. When current is supplied to the coil 14, the blocking element 10 is pulled into the dome 15 by electromagnetic forces, causing the blocking element 10 to move out of the indentation 12 in the striker 2 and to unblock the striker 2. As soon as the flow of current through the coil 14 is interrupted, a spring 16 located in the dome presses the blocking element 10 back through the opening 11 in the guide barrel 1 onto the striker 2. If the striker 2 is moving rearward and its indentation 12 reaches the location of the blocking element 10, then the blocking element 10 automatically slides into the indentation 12 because of the spring force 16 and blocks the striker 2 in its outset position.

The current flow through the coil 14 and thus the blocking time of the blocking element 10 are controlled by a control unit 17. Final control elements for the control unit 17 may for instance be an actuator 18, actuatable by the user of the hand power tool, for the striking frequency, or a pressure sensor 19, which detects the gas pressure in the pressure reservoir 5. It is thus possible to control the blocking time of the blocking element 10 as a function of a user-selectable striking frequency and/or as a function of the pressure level in the pressure reservoir 5. However, equally well, a fixed striking frequency can be predetermined for the control unit 17, which controls the current flow through the coil 14 accordingly. The control unit 17 may, however, also be supplied with still other controlling variables for the striking frequency.

The control unit 17 may furthermore be used to control the gas pressure in the pressure reservoir 5 via the electrically controllable inlet valve 6. The striking intensity can thus be controlled. For that purpose, a further final control element 20, actuatable by the user of the hand power tool, should be provided.

The invention claimed is:

1. A percussion mechanism for a repetitively hammering hand power tool in the form of a rotary hammer, the percussion mechanism having a striker (2), movable axially forward and backward in a guide barrel (1) and imparting impacts directly to an end section of a tool bit (4) that is insertable into the hand power tool, having a device (5) that exerts pressure on the striker (2), by which the striker (2) is capable of being set into a forward motion in the direction of the tool bit (4), wherein a blocking element (10) is provided, with which the striker (2) is blockable in its forward motion; and wherein the striking frequency of the striker (2) is adjustable by controlling the blocking time of the blocking element (10), so that the striking frequency of the striker (2) depends on how long the blocking element (10) blocks the forward motion of the striker (2), wherein the device exerting pressure on the striker (2) comprises a pressure reservoir (5) that is fillable with a gas and that is located on the side of the striker (2) diametrically opposite the tool bit (4), and wherein the blocking time of the blocking element (10) is controllable as a function of a pressure level in the pressure reservoir (5).

2. The percussion mechanism in accordance with claim 1, wherein the gas in the form of air is deliverable to the pressure reservoir (5) via an inlet valve (6).

3. The percussion mechanism in accordance with claim 2, wherein the quantity of the delivered gas and thus the pressure exerted on the striker (2) are controllable.

4. The percussion mechanism in accordance claim 2, wherein a pump device (7) is provided, which delivers the gas to the pressure reservoir (5).

5. The percussion mechanism in accordance with claim 4, wherein the pump device (7) is located in the hand power tool.

6. The percussion mechanism in accordance with claim 1, wherein the pressure reservoir (5) has an outlet valve (8), which limits the gas pressure to a predeterminable maximum value.

7. The percussion mechanism in accordance with claim 1, wherein the blocking time of the blocking element (10) is controllable as a function of a fixedly predetermined or user-selectable striking frequency.

8. The percussion mechanism in accordance with claim 1, further having a control unit (17) configured for adjusting the striking frequency of the striker (2) by controlling the blocking time of the blocking element (10), so that the striking frequency of the striker (2) depends on how long the blocking element (10) blocks the forward motion of the striker (2).

9. The percussion mechanism in accordance with claim 8, wherein the control unit (17) includes an electronically drivable actuator which actuates the blocking element (10).

10. The percussion mechanism as defined in claim 8, wherein said control unit (17) includes an electrically drivable actuator which comprises an electromagnet.

11. The percussion mechanism as defined in claim 8, wherein sensors (18, 19, 20) are provided, said control unit being configured to process data from at least two input channels individually connected to different ones of said sensors (18, 19, 20) for controlling the blocking time of the blocking element (10).

12. The percussion mechanism in accordance with claim 1, wherein the percussion mechanism comprises a mechanical or electrical acting device, by which the striker (2) is set into a rearward motion away from the tool bit (4).

13. The percussion mechanism as defined in claim 12, wherein the mechanical or electrical acting device is configured as a compression spring (13).

14. The percussion mechanism as defined in claim 13, wherein the compression spring (13) is located in front of said striker (2) in the direction towards said tool bit (4).

* * * * *